United States Patent [19]

Zielinski et al.

[11] Patent Number: 4,706,544

[45] Date of Patent: Nov. 17, 1987

[54] CANNON LOADER FOR SEPARATE CHARGE AND PROJECTILE

[75] Inventors: Erich Zielinski, Haan; Theo Heckenbach, Krefeld-Stratum, both of Fed. Rep. of Germany

[73] Assignee: Rheinmetall GmbH, Duesseldorf, Fed. Rep. of Germany

[21] Appl. No.: 786,340

[22] Filed: Oct. 10, 1985

[30] Foreign Application Priority Data

Oct. 13, 1984 [DE] Fed. Rep. of Germany ..... 3437588

[51] Int. Cl.[4] ..... F41F 9/06

[52] U.S. Cl. ..... 89/46; 89/34; 89/36.13

[58] Field of Search ..... 89/33.05, 33.1, 34, 89/36.8, 36.13, 45, 46, 47

[56] References Cited

U.S. PATENT DOCUMENTS 4,457,209 7/1984 Scheurich et al. ..... 89/34

FOREIGN PATENT DOCUMENTS 2027586 1/1976 Fed. Rep. of Germany .

33000 3/1978 Japan ..... 89/46

*Primary Examiner*—Stephen C. Bentley

[57] ABSTRACT

A turret carrying an axis-defining gun barrel having a rear-end breech and pivotal in the turret about a horizontal elevation axis transverse to the barrel axis has an apparatus in the turret behind the breech for separately loading projectiles and charges into the breech. This loading apparatus comprises respective projectile and charge magazines in the turret behind the breech set up to feed the projectiles and charges to respective pickup locations both located in the turret horizontally to the same one side of the barrel axis. A loading arm pivotal about the horizontal axis is provided with respective projectile and charge grabs movable on and with the arm between respective pickup positions at the respective stations and loading positions aligned with the breech. Thus in the loading positions the projectiles and charges can be pushed from the grabs into the breech.

10 Claims, 8 Drawing Figures

CANNON LOADER FOR SEPARATE CHARGE AND PROJECTILE

FIELD OF THE INVENTION

The present invention relates to a cannon loader. More particularly this invention concerns such a loader for a cannon with separate-loading ammunition.

BACKGROUND OF THE INVENTION

Separate-loading ammunition comprising a projectile and an independent charge is typically shot by large-bore cannons of the type used as the main gun of a tank. It is possible for such systems to dispose of a selection of charges for different ranges, or for more or fewer individual charge packs to be employed to achieve a similar variable effect.

Thus in the gun turret behind the breech of the barrel, which is invariably pivotal about a horizontal elevation axis perpendicular to its bore axis, it is necessary to provide a magazine for the projectiles and a magazine for the charges, one on each side of the turret. As described in German patent document No. 2,027,586 filed by A. Gauci based on a French priority of 4 June 1985, two separate grabs are provided, one for the charges and one for the projectiles. These grabs in turn have separate lateral conveyors and a central loading device is furthermore provided behind the breech and between the grabs to sequentially push the projectile from its grab and then the charge from its grab into the breech. Thus this device takes up quite a bit of valuable space, making the turret fairly large and high, and also is quite slow due to the sequential two-part operation of separately chambering the projectile and charge. The small saving in depth achieved by using separate-loading ammunition is therefore lost to the other complex and bulky loading equipment. Furthermore such an arrangement is impossible to load manually, and is very difficult to service because there is so much equipment cluttering the area behind the breech.

A similar such device with individual loaders for the charge and projectile is also described in U.S. Pat. No. 4,457,209. Although offering certain advantages, this arrangement is still quite bulky, also making it unsuitable for howitzer use in high-angle shooting, as the barrel must be swung down for reloading.

OBJECTS OF THE INVENTION

It is therefore an object of the present invention to provide an improved loader for two-part ammunition.

Another object is the provision of such a loader for two-part ammunition which overcomes the above-given disadvantages, that is which is relatively compact yet which still can feed the breech with separate-loading ammunition even when the barrel is pointing up at a high angle.

SUMMARY OF THE INVENTION

A turret carrying an axis-defining gun barrel having a rear-end breech and pivotal in the turret about a horizontal elevation axis transverse to the barrel axis has an apparatus in the turret behind the breech for separately loading projectiles and charges into the breech. This loading apparatus comprises respective projectile and charge magazines in the turret behind the breech set up to feed the projectiles and charges to respective pickup locations both located in the turret horizontally to the same one side of the barrel axis. A loading arm pivotal about the horizontal axis is provided with respective projectile and charge grabs movable on and with the arm between respective pickup positions at the respective stations and loading positions aligned with the breech. Thus in the loading positions the projectiles and charges can be pushed from the grabs into the breech.

Thus the system of this invention is fairly simple, and can leave the other side of the turret adjacent the breech completely clear so that the gun can be manually loaded if desired, and so that servicing the autoloader is easy. The short path that the charges and projectiles must move through furthermore allows the device to operate rapidly.

According to this invention both of the grabs are pivotal on the arm about a common axis lying in a plane substantially perpendicular to the azimuth axis. It is also possible for one of the grabs to be pivotal on the arm about an lying in a plane substantially perpendicular to the azimuth axis and the other grab to be pivotal on the one grab about an axis generally parallel to the axis of the one grab. Such pivoting can make the paths through which the projectiles and charges move very short. This feature is further enhanced when the pickup station of the projectile is closer to the barrel axis than the pickup station of the charge. Such construction facilitates loading the projectile into the chamber first and pushing it into place therein before the charge has been brought into position. In this regard it is noted that putting the charge and projectile together and pushing them in by pushing on the charge is dangerous and at best is likely to break open the charge packs constituting the charge.

In accordance with another feature of this invention the charge magazine is formed with a lateral feed channel terminating at the charge pickup station and is provided with a plurality of individual charge-holding compartments opening into the channel and each provided with devices for releasing one of the respective charges held therein into the channel. In addition a feed device is provided for advancing along the channel to the charge pickup station the charges released from the compartments into the channel. For safety's sake the charge magazine is a closed container having an opening only at the charge pickup station and is provided with an armored door normally blocking this opening. Furthermore the charge magazine lies wholly to the one side of the plane and the projectile magazine lies mainly on the other side of the plane but extends across the plane to the one side thereof.

The charge and projectile grabs of this invention can close and open hand-like to hold and release the respective charges and projectiles. Furthermore the grabs are pivotal on the arm about at least one axis that is horizontal when the grabs are engaged in the respective stations.

DESCRIPTION OF THE DRAWING

The above and other features and advantages will become more readily apparent from the following, reference being made to the accompanying drawing in which.

SPECIFIC DESCRIPTION

Figure 1:
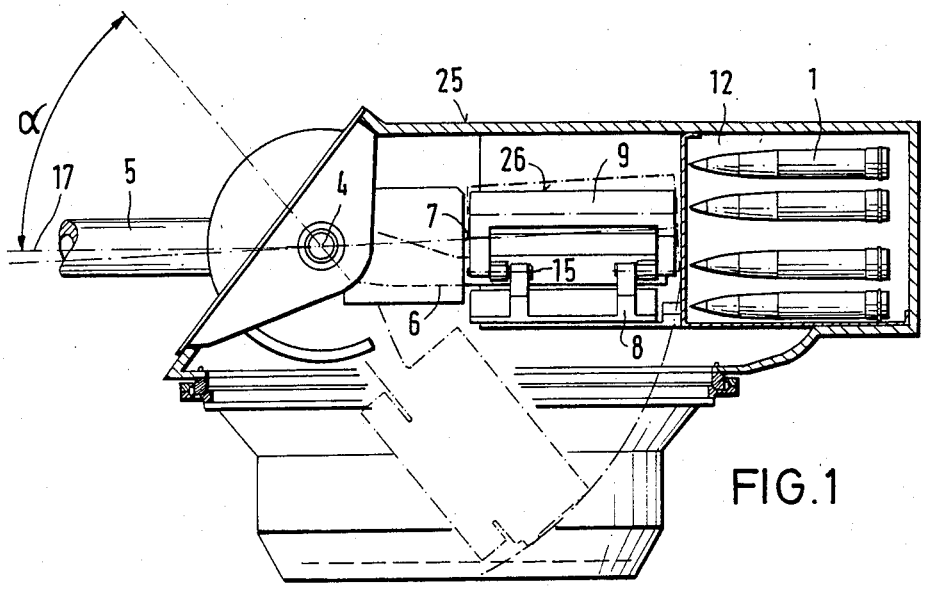
FIG. 1 is a vertical section through the turret of an autoloading gun according to this invention.
Figure 2:
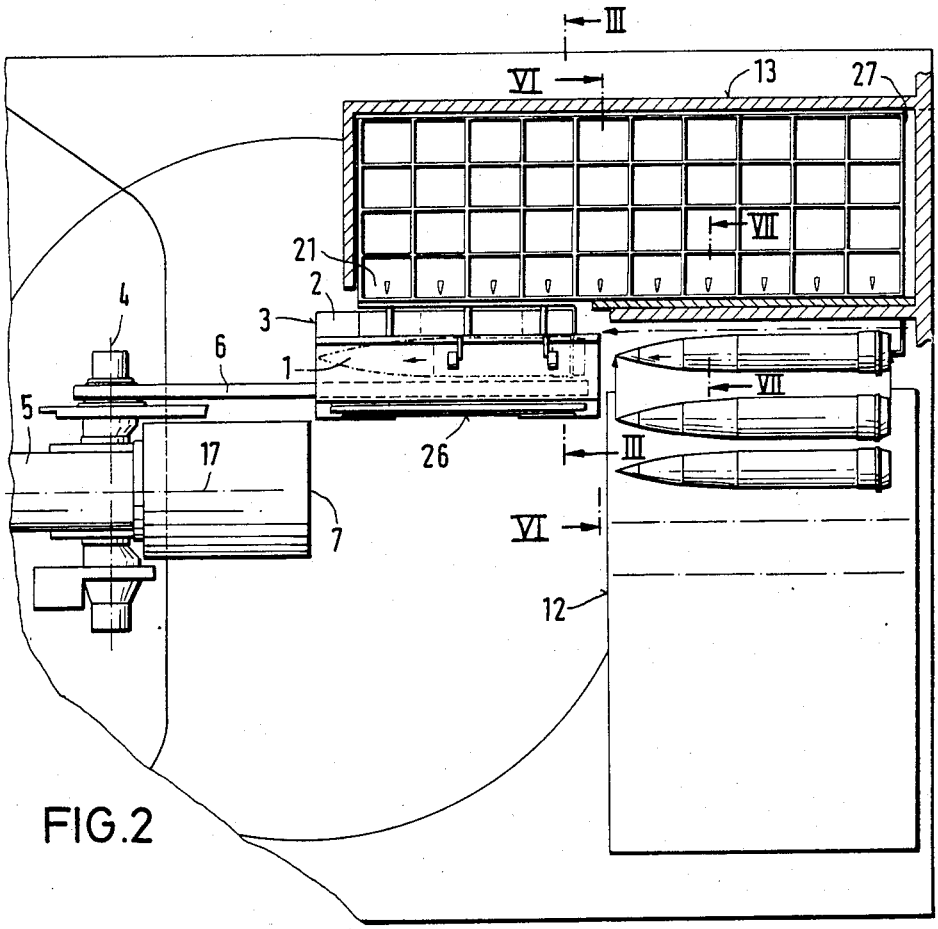
FIG. 2 is a horizontal section through the turret of FIG. 1.

As seen in FIGS. 1, 2, 3, and 6, a turret 25 carries a large barrel 5 centered on an axis 17 and pivotal on the turret 25 about a horizontal elevation axis 4 perpendicularly intersecting the axis 17 for swinging of the barrel 5 through an arc a with the axis 17 in a vertical plane P. The rear end of the barrel 5 has a rear-loading breech 7. Inside the turret 25 behind (to the left in FIGS. 1 and 2) the breech 7 is on one side a magazine 12 for projectiles 1 and on the other side a magazine 13 for individual charge packs 2. A cassette or container 27 formed with compartments 21 holding the packs 2 lines the magazine 13 which lies wholly to the right side of the barrel 5, that is to the vertical plane P defined by the axis 17.

Figure 6:
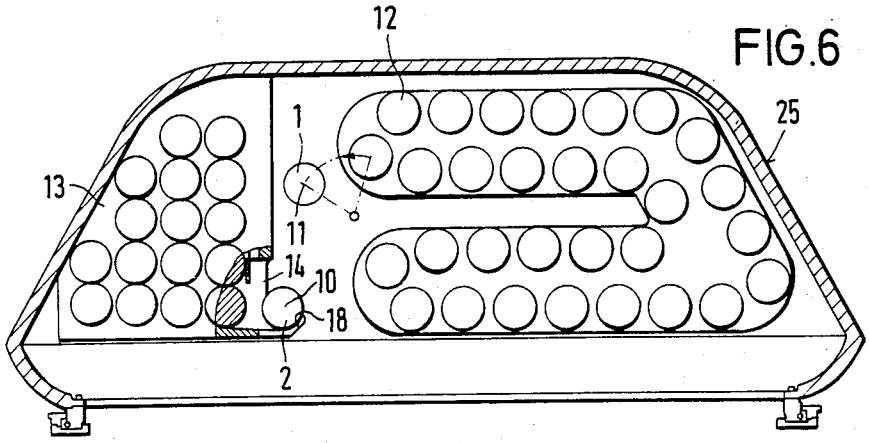
FIGS. 6 and 7 are small- and large-scale sections respectively taken along lines VI—VI and VII—VII of FIG. 2.

The magazine 12 is located wholly behind the breech 7, in fact spaced somewhat rearward therefrom to form an open space 34 immediately behind and to the left of the breech 7, but extends somewhat to the right-hand side of the plane P. The magazine 12 holds the projectiles 1 in a meander as seen in FIG. 6 so that an automatic unloader shown schematically at 35 can displace the projectiles 1 into a pickup position or station indicated at 11 which lies wholly to the right side of the plane P.

Figure 7:
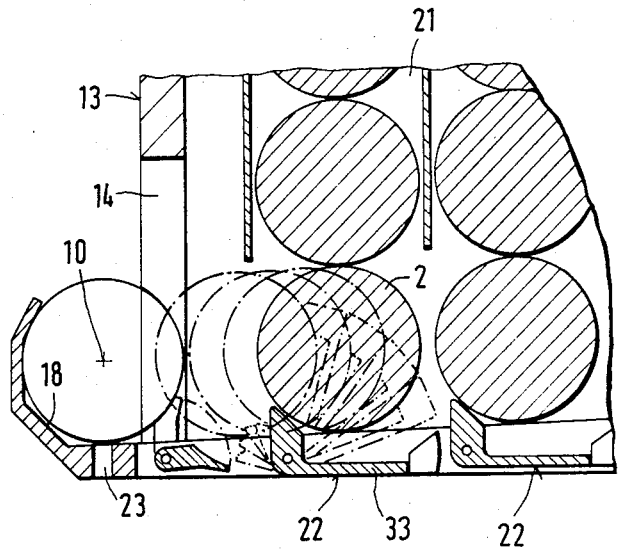
Figure 8:
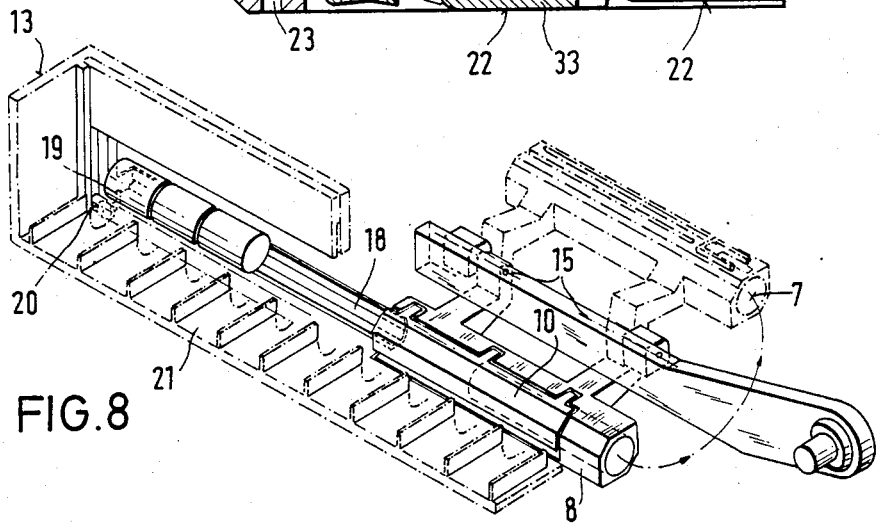
FIG. 8 is a perspective view of the charge-loading parts of the apparatus.

The magazine 13 has an outlet opening 14 normally blocked by an armored plate 24 and emptying into a horizontal trough 18 extending parallel to the plane P. It has a floor 28 inclined toward the trough 18 to roll the cylindrical charges 2 in this direction as the container 27 empties. As best seen in FIGS. 7 and 8 fingers 19 of a drive chain of a feed device 20 project upward through a slot 23 in the bottom of the channel 18 to push the individual packs 2 forward. Thus charges 3 are assembled in the front end of the channel 18 in a pickup station 10 almost directly below the station 11. The individual charge packs are fed by individually pivotally actuatable levers 33 of an unlocking device 22 out of the compartments 21 into the trough 18.

The projectiles 1 and charges 2 are loaded into the breech by an apparatus 26 comprising a main transfer arm 6 having a front end pivoted at the axis 4 and a rear end carrying an upper grab 9 for the projectiles 1 and a lower grab 8 for the charges 2. These grabs 8 and 9 are of the openable claw type and and are carried on respective arms 29 and 30 pivoted at an axis 15 which is horizontal when the projectiles 1 and charges 2 are picked up and which is parallel to the barrel axis 17 as the picked up projectiles 1 and charges 2 are pushed axially forward into the breech 7.

Figure 3:
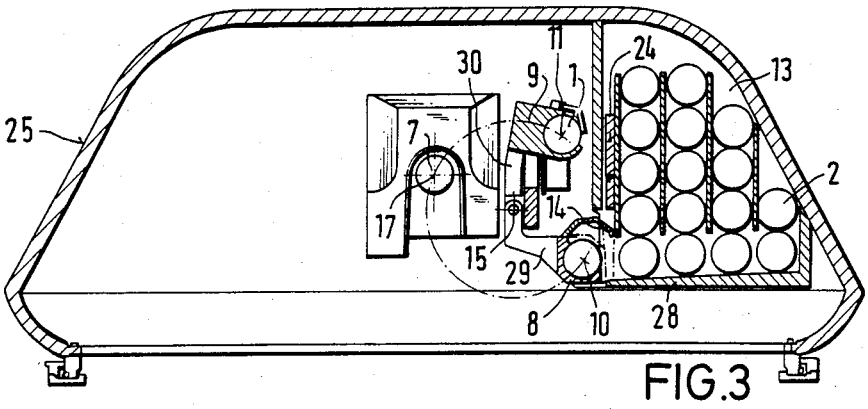
FIG. 3 is a vertical section taken along line III—III of FIG. 2.
Figure 4:
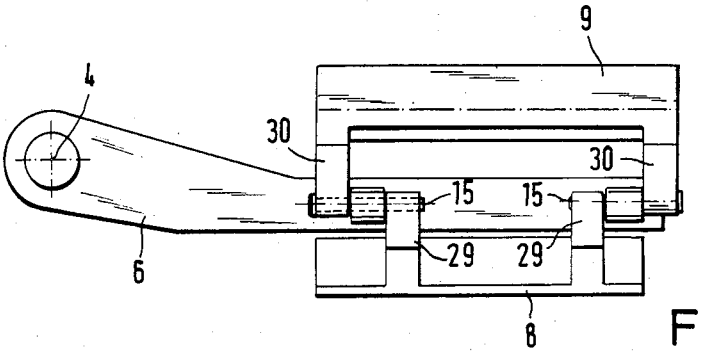
FIG. 4 is a side view of the loading arm of the apparatus of this invention.

Thus in order to load the cannon, the arm 6 is swung up to the position seen in FIG. 3 and the grab 9 is swung up and over to pick up a projectile 1 from the station 11 and the grab 8 is swung down and over to pick up a charge 2 in the station 10. The grabs 8 and 9 both close and then are pivoted over toward the center with, if necessary, simultaneous pivoting of the arm 6 about the axis as shown in dashed lines in FIG. 1 so that the picked-up projectile 1 and charge 2 are axially aligned with the breech 7, whereupon they can be chambered. This operation takes place wholly to the center and right-hand side of the turret 25 so that the space 34 is left unencumbered for manual loading of the breech 7 and servicing of the loading apparatus.

Figure 5:
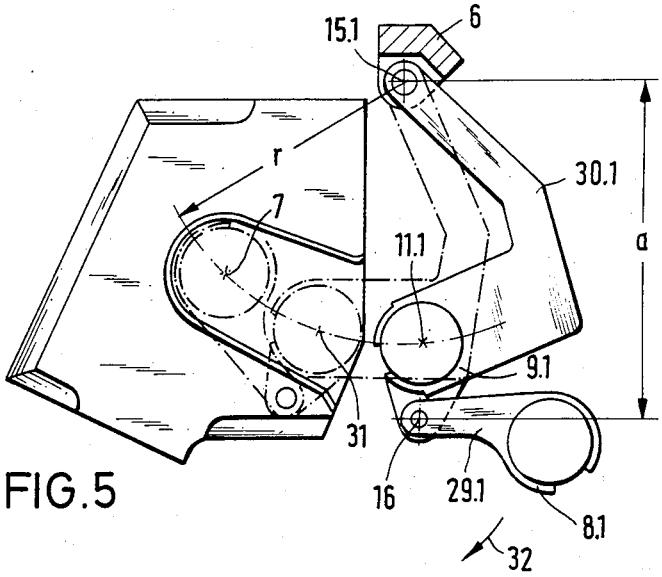
FIG. 5 is an end view of another loading arm according to the invention.

FIG. 5 shows an arrangement wherein a charge grab 8.1 is carried on arms 29.1 and pivotal about an axis 16 on the outer end of the grab 9.1 which in turn is carried on arms 30.1 pivotal about an axis 15.1 parallel to the axis 16 and equivalent to the axis 15. The axes 15.1 and 16 are spaced a a relatively short distance D. Thus it is possible for the arrangement to first pivot into position with the grab 9.1 aligned with the breech 7 and then to pivot the grab 8.1 to align it with the breech, the whole operation having a radius r of operation that is quite small.

The system of this invention is therefore relatively simple and compact. It works wholly to one side of the breech so that the other side of it is free for personnel use. The functions of the various transverse and longitudinal conveyors of the prior art are all carried out by the arm 6 and grabs 8 and 9, which can load the cannon in any position of the barrel 5, even with it pointing well up.

What is claimed is:

1. In combination with a turret carrying an axis-defining gun barrel having one side and a rear-end breech and pivotal in the turret about a horizontal elevation axis transverse to the barrel axis, an apparatus in the turret behind the breech for separately loading projectiles and charges into the breech, the loading apparatus comprising:

respective projectile and charge magazines in the turret behind the breech including respective means for feeding the projectiles and charges to respective pickup positions both located in the turret horizontally to the same one side of the barrel axis;

a loading arm pivotal about the horizontal axis; and respective projectile and charge grabs movable on and with the arm between respective pickup positions and loading positions aligned with the breech, whereby in the loading positions the projectiles and charges can be pushed from the grabs into the breech.

2. The loading apparatus defined in claim 1 wherein both of the grabs are pivotal on the arm about a common axis lying in a plane substantially perpendicular to the azimuth axis.

3. The loading apparatus defined in claim 1 wherein one of the grabs is pivotal on the arm about an lying in a plane substantially perpendicular to the elevation axis and the other grab is pivotal on the one grab about an axis generally parallel to the axis of the one grab.

4. The loading apparatus defined in claim 1 wherein the pickup station of the projectile is closer to the barrel axis than the pickup station of the charge.

5. The loading apparatus defined in claim 1 wherein the charge magazine is formed with a lateral feed channel terminating at the respective pickup station and is provided with a plurality of individual charge-holding compartments opening into the channel and each provided with means for releasing one of the respective charges held therein into the channel.

6. The loading apparatus defined in claim 5, further comprising feed means for advancing the charges released from the compartments into the channel along the channel to the charge pickup station.

7. The loading apparatus defined in claim 1 wherein the charge magazine is a closed container having an opening only at the charge pickup station and is provided with an armored door normally blocking this opening.

8. The loading apparatus defined in claim 1 wherein the charge magazine lies wholly to the one side of a plane and the projectile magazine lies mainly on the other side of the plane but extends across the plane to the one side thereof.

9. The loading apparatus defined in claim 1 wherein the charge and projectile grabs close and open to hold and release the respective charges and projectiles.

10. The loading apparatus defined in claim 1 wherein the grabs are pivotal on the arm about at least one axis that is horizontal when the grabs are engaged in the respective stations.

* * * * *